US007296924B2

(12) United States Patent
Czarnek

(10) Patent No.: US 7,296,924 B2
(45) Date of Patent: Nov. 20, 2007

(54) VORTEXER

(75) Inventor: Robert Czarnek, Johnstown, PA (US)

(73) Assignee: Advanced Analytical Technologies, Inc., Ames, IA (US)

( * ) Notice: Subject to any disclaimer, the term of this patent is extended or adjusted under 35 U.S.C. 154(b) by 308 days.

(21) Appl. No.: 11/059,224

(22) Filed: Feb. 16, 2005

(65) Prior Publication Data

US 2005/0180258 A1 Aug. 18, 2005

Related U.S. Application Data

(60) Provisional application No. 60/545,159, filed on Feb. 17, 2004.

(51) Int. Cl.
*B01F 11/00* (2006.01)

(52) U.S. Cl. ..... 366/208; 366/213; 366/218

(58) Field of Classification Search ..... 366/213, 366/208, 218
See application file for complete search history.

(56) References Cited

U.S. PATENT DOCUMENTS

| | | | | |
|---|---|---|---|---|
| 2,876,083 | A * | 3/1959 | Prietl | 366/127 |
| 3,601,372 | A * | 8/1971 | Harmes | 366/219 |
| 3,830,099 | A * | 8/1974 | Ichikawa | 366/127 |
| 3,975,001 | A | 8/1976 | Moore et al. | |
| 4,023,527 | A * | 5/1977 | DeMayo | 366/127 |
| 4,046,515 | A * | 9/1977 | de Leeuw | 366/117 |
| 4,305,668 | A | 12/1981 | Bilbrey | |
| 4,345,843 | A * | 8/1982 | Berglund et al. | 366/219 |
| 4,463,602 | A * | 8/1984 | Stoddard et al. | 366/108 |
| 4,555,183 | A * | 11/1985 | Thomas | 366/208 |
| 4,610,546 | A * | 9/1986 | Intraub | 366/110 |
| 5,145,640 | A * | 9/1992 | Levin | 366/127 |
| 5,409,312 | A * | 4/1995 | Fletcher | 366/208 |
| 5,427,451 | A * | 6/1995 | Schmidt | 366/208 |
| 5,511,879 | A * | 4/1996 | Fletcher | 366/208 |
| 5,567,050 | A * | 10/1996 | Zlobinsky et al. | 366/209 |
| 6,141,604 | A | 10/2000 | Mattes et al. | |
| 6,213,681 | B1 * | 4/2001 | Sick et al. | 366/116 |
| 6,332,705 | B1 * | 12/2001 | Herz et al. | 366/208 |
| 6,424,897 | B1 | 7/2002 | Mattes et al. | |
| 6,508,582 | B2 * | 1/2003 | Friedman | 366/110 |
| 6,605,252 | B2 * | 8/2003 | Omasa | 366/118 |
| 6,659,637 | B2 * | 12/2003 | Friedman | 366/110 |
| 7,141,029 | B2 * | 11/2006 | Kim | 601/78 |
| 2001/0030906 | A1 * | 10/2001 | Friedman | 366/114 |
| 2002/0044495 | A1 * | 4/2002 | Friedman | 366/110 |
| 2002/0075140 | A1 | 6/2002 | Yeh et al. | |
| 2005/0180258 | A1 * | 8/2005 | Czarnek | 366/213 |
| 2006/0187743 | A1 * | 8/2006 | Carreras | 366/111 |

FOREIGN PATENT DOCUMENTS

| | | |
|---|---|---|
| DE | 196 09 176 | 9/1997 |
| DE | 197 44 083 | 4/1999 |

* cited by examiner

*Primary Examiner*—Tony G. Soohoo
(74) *Attorney, Agent, or Firm*—The Webb Law Firm

(57) ABSTRACT

A vortexer that includes a base, a plurality of electromagnets mounted in the base, a holder having a body formed, at least in part, of magnetic material pivotably supported on the base and spaced above the electromagnets, a power source and a device in communication with the electromagnets and the power source for selectively activating and deactivating each electromagnet with power from the power source, whereupon the holder pivotably moves toward at least one of the electromagnets when activated.

9 Claims, 8 Drawing Sheets

VORTEXER

CROSS REFERENCE TO RELATED APPLICATION

This application claims the benefit of U.S. Provisional Patent Application Ser. No. 60/545,159, filed Feb. 17, 2004, which is hereby incorporated by reference in its entirety.

BACKGROUND OF THE INVENTION

1. Field of the Invention

This invention relates generally to an apparatus for mixing fluids held in laboratory vessels, such as test tubes and, more particularly, to a vortexer capable of agitating by electromagnetic means.

2. Description of Related Art

Vortex mixers (often referred to as vortexers) used to mix liquids in a laboratory environment are well known in the art. Prior art vortexers typically carry out mixing operations on one or a plurality of containers, such as test tubes, beakers and flasks. These vortexers are generally described in U.S. Pat. No. 4,305,668.

With reference to FIG. 1, a prior art vortexer 8 includes a base 10, a motor 11 mounted to the base 10, an agitated platform 12 resiliently supported from the base 10 and connected to a motor 11 by an eccentric crank and coupling 13. The agitated platform 12 is resiliently supported upon a set of wires 14, the lower end of each wire 14 being secured in a holder 15 mounted to base 10. A housing 16 encloses motor 11, wire 14 and the operating circuitry of the prior art vortexer 8. This arrangement is well known and is utilized in connection with other forms of vortexers.

The typical prior art vortexer, which generally has a significant number of components, such as joints, bearings and an electrical motor, is relatively expensive, noisy and produces a substantial amount of vibration. Although attempts have been made to dampen some of the noise and vibration in these prior art vortexers, such as providing the base with rubber suction cup feet, the vibration and the noise cannot be significantly reduced because of the number of moving parts and the inherent vibration caused by the motor and eccentric crank and coupling design. Therefore, it would be desirable to overcome the above-mentioned deficiencies by providing an electromagnetic vortexer having minimal vibration and a minimum number of moving parts.

SUMMARY OF THE INVENTION

The present invention is a vortexer that includes an enclosure, an upwardly extending shaft in the enclosure, a plurality of electromagnets arranged around the shaft, a holder pivotably supported by the shaft and spaced above the electromagnets, a power source, and a device in communication with the electromagnets and the power source for selectively activating each electromagnet with power from the power source, whereupon the holder pivots or wobbles with respect to the enclosure.

DETAILED DESCRIPTION OF THE INVENTION

Figure 1:
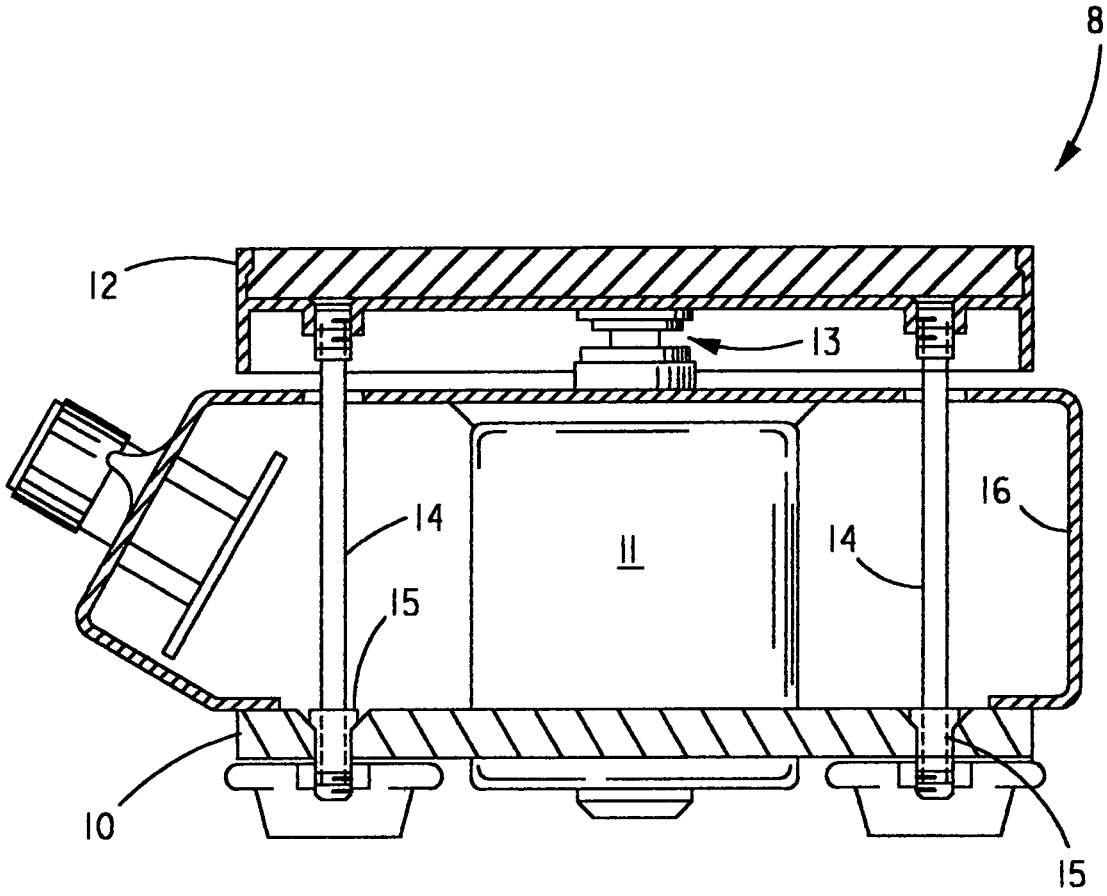
FIG. 1 (PRIOR ART)
FIG. 1 is a sectional side view of a prior art vortexer.
Figure 2:
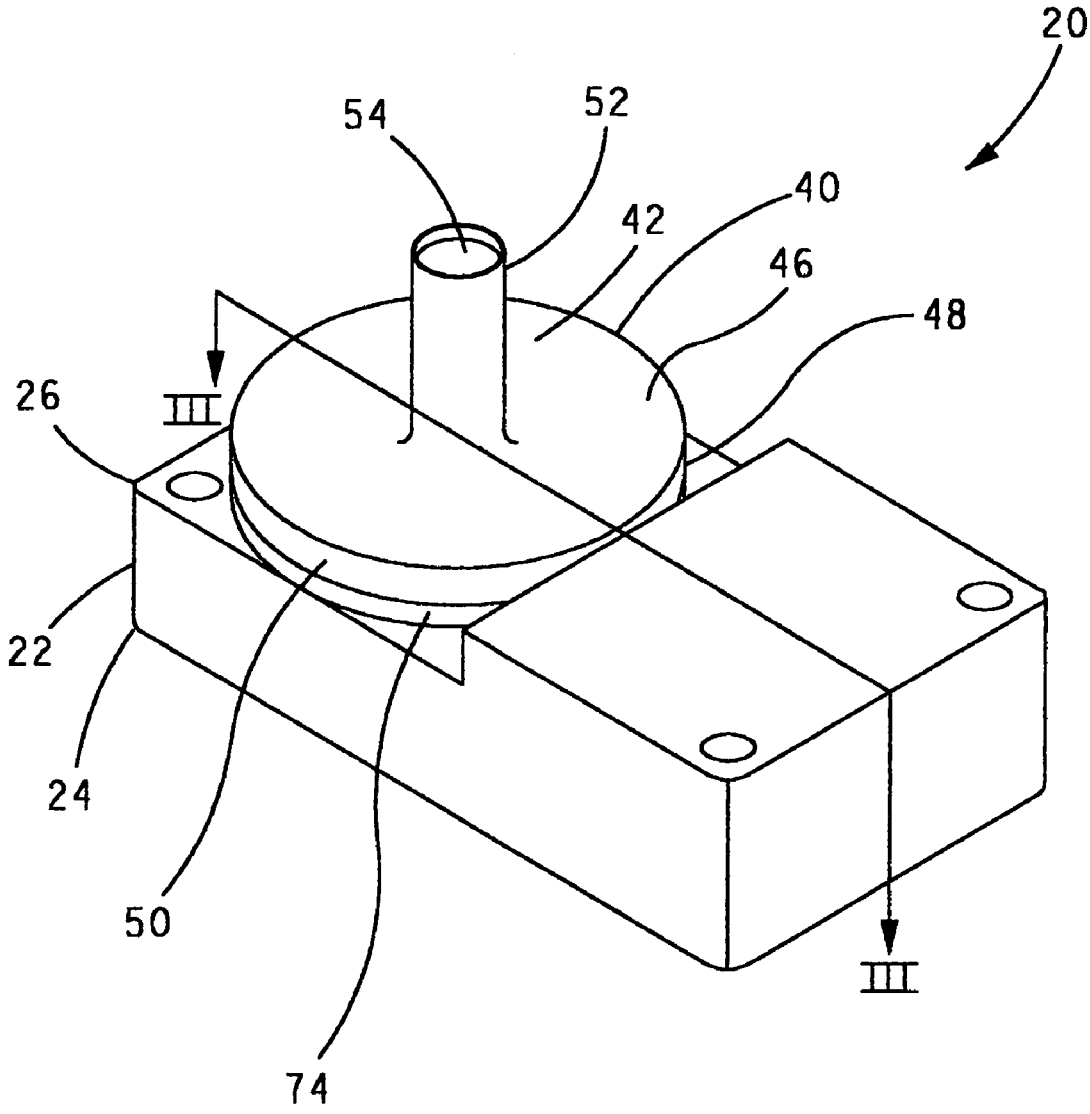
FIG. 2 is a perspective view of a vortexer in accordance with the present invention.

With reference to FIGS. 2-5, the present invention is a vortexer 20 for mixing operations in a laboratory environment. Vortexer 20 provides a uniform vortexing action with minimal vibration and a minimum number of moving parts.

Vortexer 20 includes an enclosure 22 having a lower surface 24, an upper surface 26 and sides that define an interior cavity 28. As shown best in FIGS. 3*a* and 3*b*, cavity 28 includes an upwardly extending opening 30 having a ring-shaped lip 32 adjacent an upper end thereof. Lip 32 has an upper surface 33*a* and a lower surface 33*b*. A threaded end of a fastener 34 can extend through the opening of ring-shaped lip 32 and terminate above upper surface 33*a* of lip 32. A washer 39, such as, without limitation, an elastic washer, can be positioned between lower surface 33*b* of lip 32 and a head of fastener 34 to prevent the head from passing through the opening of ring-shaped lip 32. Fastener 34 may be a screw or any other suitable fastener having a shaft.

A plurality of electromagnets 36, for example, without limitation, four electromagnets 36, having a top surfaces 38 is circumferentially arranged around fastener 34 and opening 30 of cavity 28.

Cavity 28 can include separate compartments 29, each of which is configured to receive an electromagnet 36, thus separating electromagnets 36 from each other. Enclosure 22 can also include a plurality of fasteners 31, each of which extends into a corresponding compartment 29. Each fastener 31 is threadedly mated within a threaded opening 37 of an electromagnet 36 positioned in the corresponding compartment 29 for securing the electromagnet 36 therein.

Figure 3A:
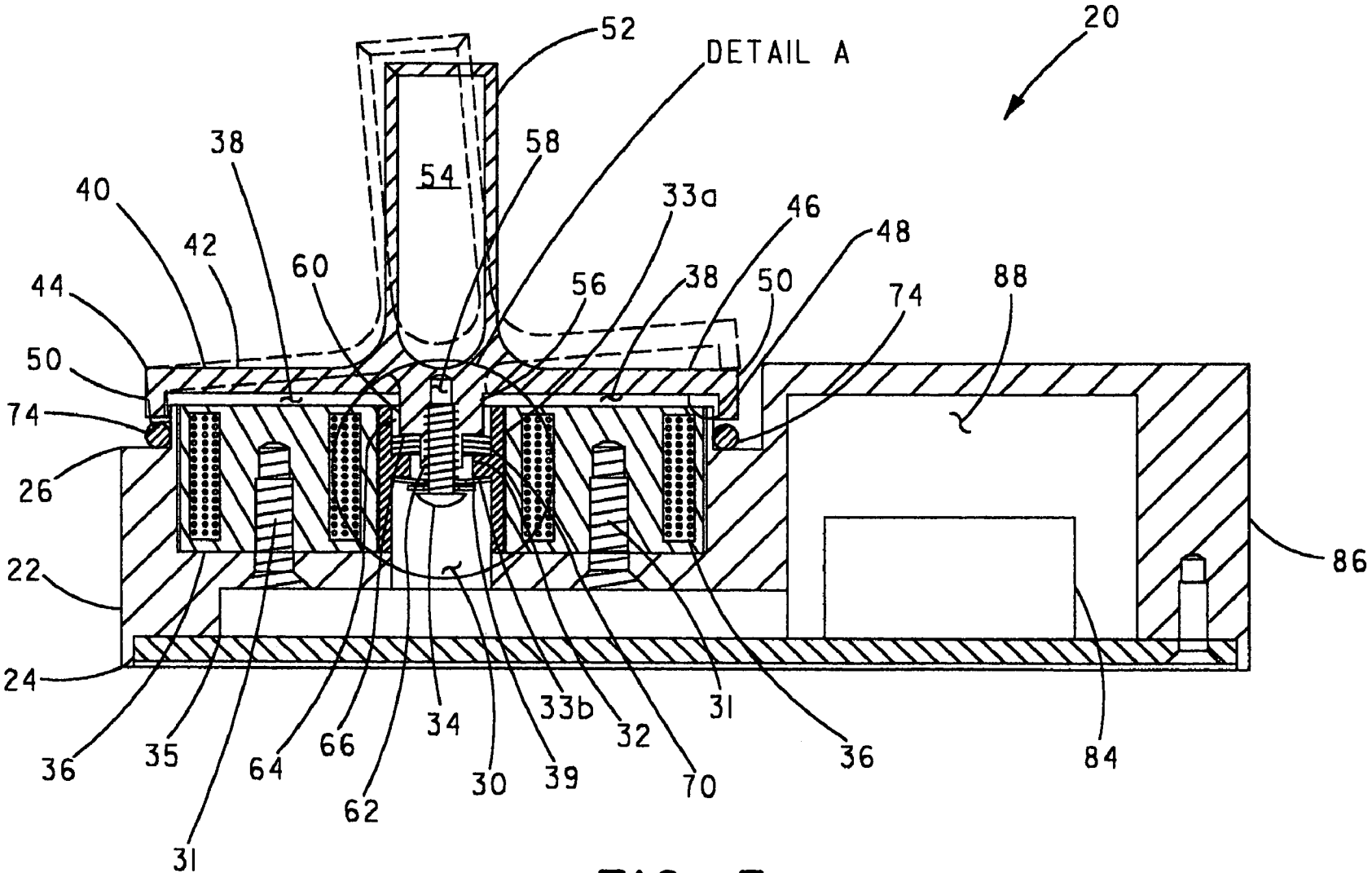
FIG. 3*a* is a sectional view taken along lines III-III in FIG. 2.
Figure 3B:
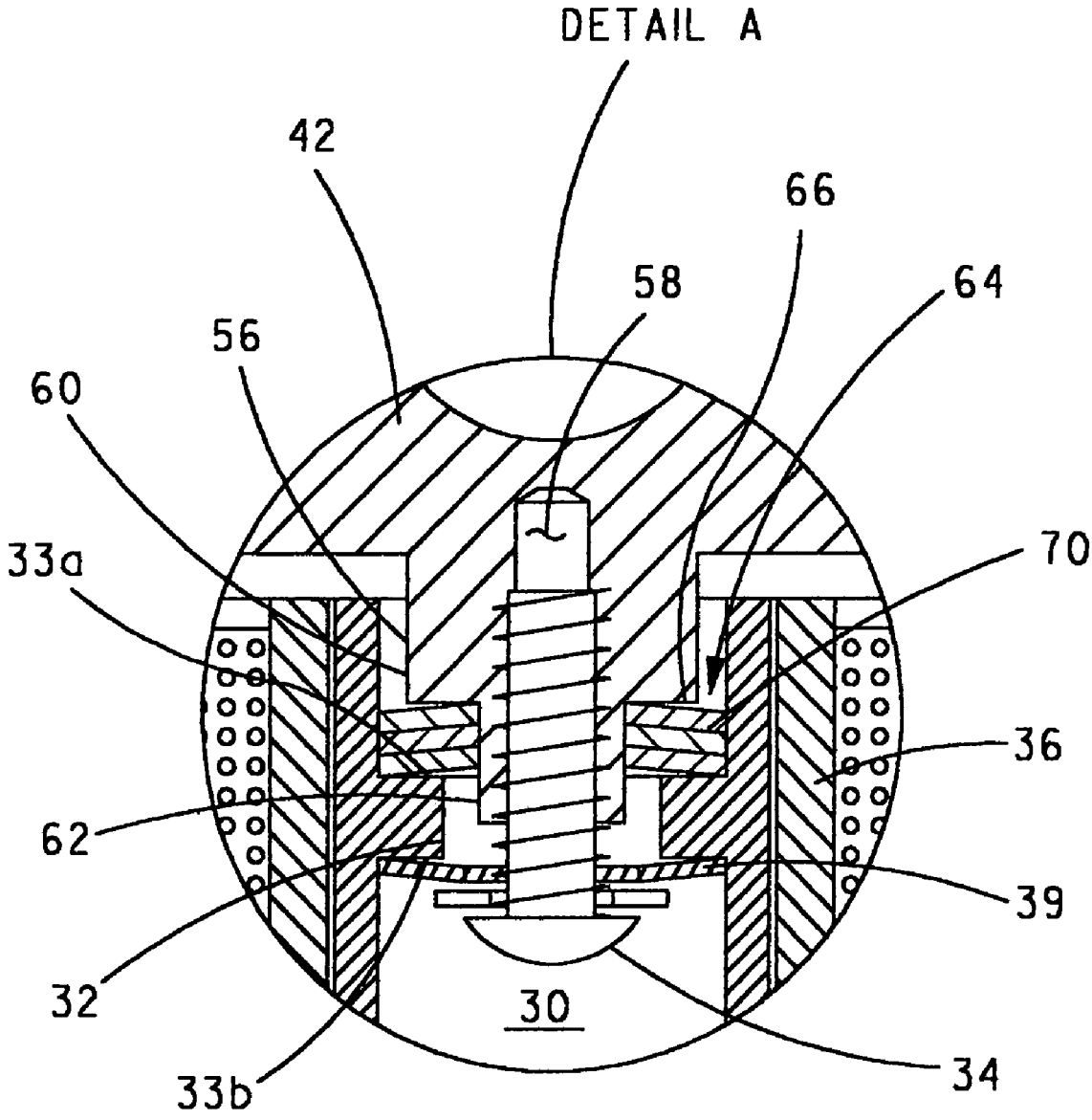
FIG. 3*b* is an isolated view of detail A in FIG. 3*a;*
Figure 4:
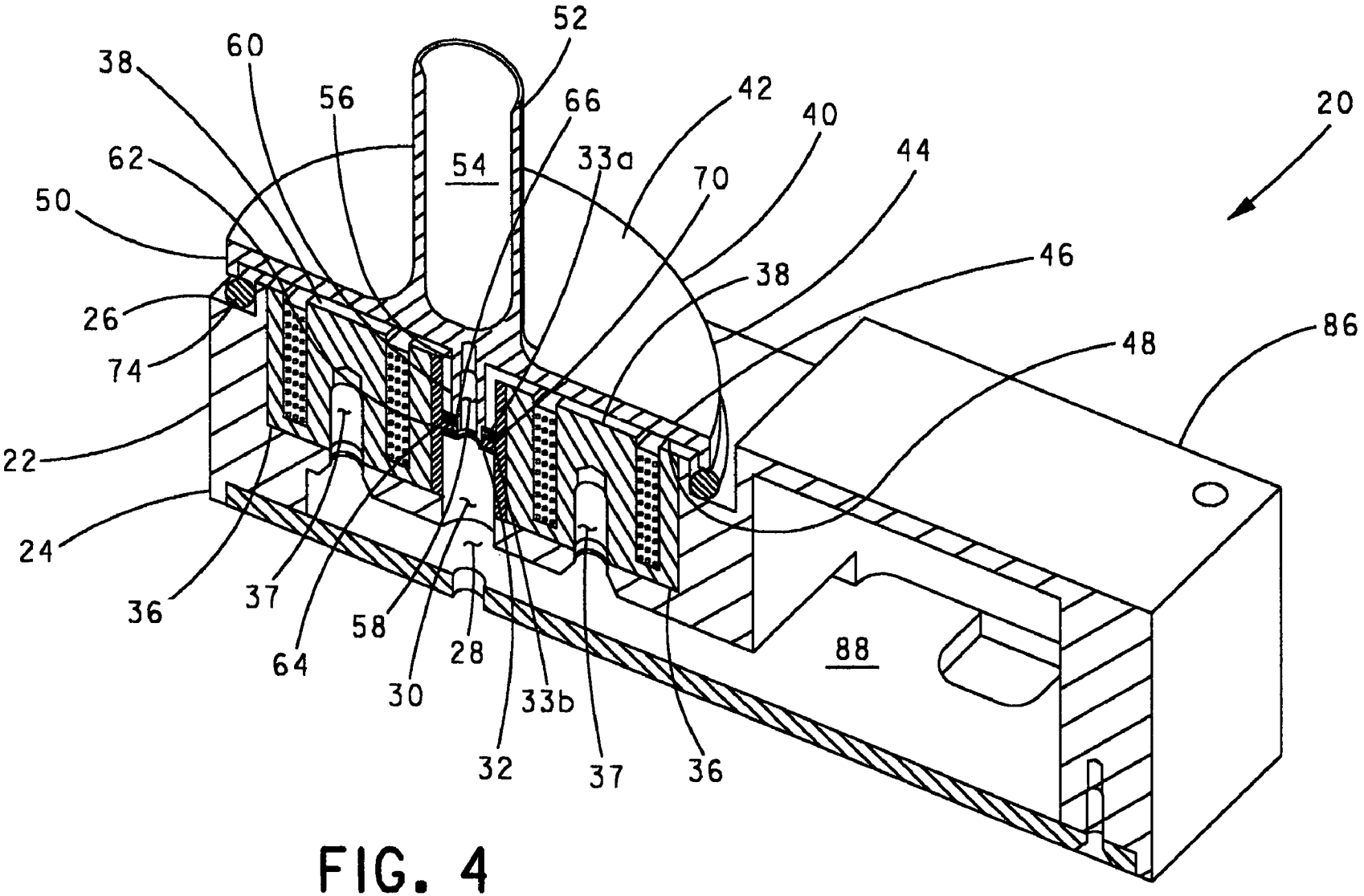
FIG. 4 is a perspective view of the vortexer shown in FIG. 3*a* absent the mounting fasteners that secure the electromagnets in position.

As shown best in FIGS. 3*a*, 3*b* and 4, vortexer 20 also includes a sample holder 40 having a disk-shaped body 42 defining a peripheral edge 44. Body 42 of holder 40 is desirably made of a magnetic material. However, it is envisioned that body 42 can be made of a non-magnetic material and a second or lower side 48 of body 42 can have magnetic material attached thereto.

Sample holder 40 is pivotably supported on upper surface 33*a* of lip 32 (in a manner described hereinafter) in spaced relation to electromagnets 36. Body 42 has a first or upper side 46 and includes a peripheral lip 50 extending from peripheral edge 44. Lip 50 extends laterally, desirably perpendicularly, away from second side 48 of body 42.

First side 46 of body 42 includes a cylindrical member 52 that is either attached thereto or formed integrally therewith and which is spaced from peripheral edge 44. Cylindrical member 52 extends laterally, desirably perpendicularly, away from first side 46 of body 42 and includes therein a bore 54 configured to receive and hold a laboratory container (not shown), such as a test tube. Cylindrical member 52 and/or bore 54 can be any desirable size or shape.

Second side 48 of body 42 includes a cylindrical protrusion 56 that is either attached thereto or formed integrally therewith and which is spaced from peripheral edge 44 and extends laterally, desirably perpendicularly, away from second side 48 of body 42. An exterior of protrusion 56 includes a shoulder 64 having a surface 66 positioned facing upper surface 33*a* of ring-shaped lip 32. Protrusion 56 includes a bore 58 therein for receiving the threaded end of fastener 34. Bore 58 can have internal threads for threadly mating the threaded end of fastener 34 to protrusion 56, whereupon body 42 is pivotably supported on lip 32.

Vortexer 20 includes one or a stack of elastic washers 70 or bearings (shown best in FIG. 3*b*) surrounding the exterior of protrusion 56 between surface 66 of shoulder 64 and upper surface 33*a* of ring-shaped lip 32. The threaded end of fastener 34 is threadly received in bore 58 of protrusion 56, whereupon washer(s) 70 are compressed or preloaded between shoulder 64 and ring-shaped lip 32. The preload on washer(s) 70 and, hence, the distance between upper surface 33*a* of lip 32 and surface 66 of shoulder 64 can be adjusted by increasing or decreasing the distance the threaded end of fastener 34 is received within bore 58 of protrusion 56. When body 42 is coupled to lip 32 via fastener 34 and washer(s) 70, body 42 can pivot or tilt about fastener 34. Washer(s) 70 urge body 42 to the upright position shown in FIG. 3*a*, thereby providing resistance to the pivotal movement of body 42, shown in phantom in FIG. 3*a*.

Figure 5:
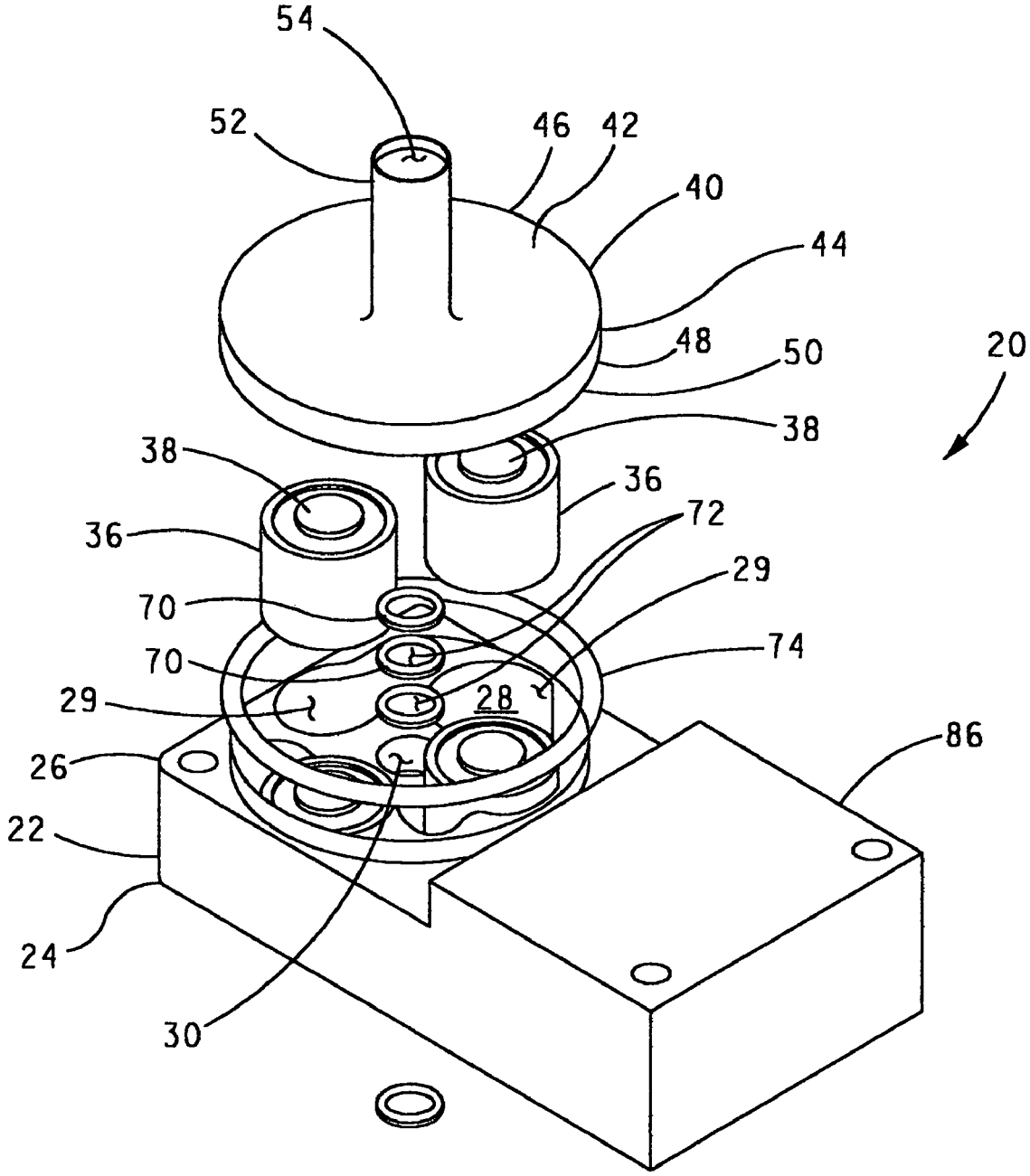
FIG. 5 is an exploded perspective view of the vortexer shown in FIG. 2.

As shown best in FIGS. 3*a*, 4 and 5, vortexer 20 includes a ring or gasket 74 mounted on top surface 26 of enclosure 22 around electromagnets 36 and spaced below lip 50 of body 42. When one or more electromagnets 36 are activated, body 42 pivots toward the activated electromagnet(s) 36 whereupon lip 50 contacts ring 74 as shown in phantom in FIG. 3*a*. Ring 74 can function as a surface for consecutive portions of lip 50 to sequentially contact when holder 40 undergoes a wobbling motion in response to sequentially activating electromagnets 36.

Figure 6:
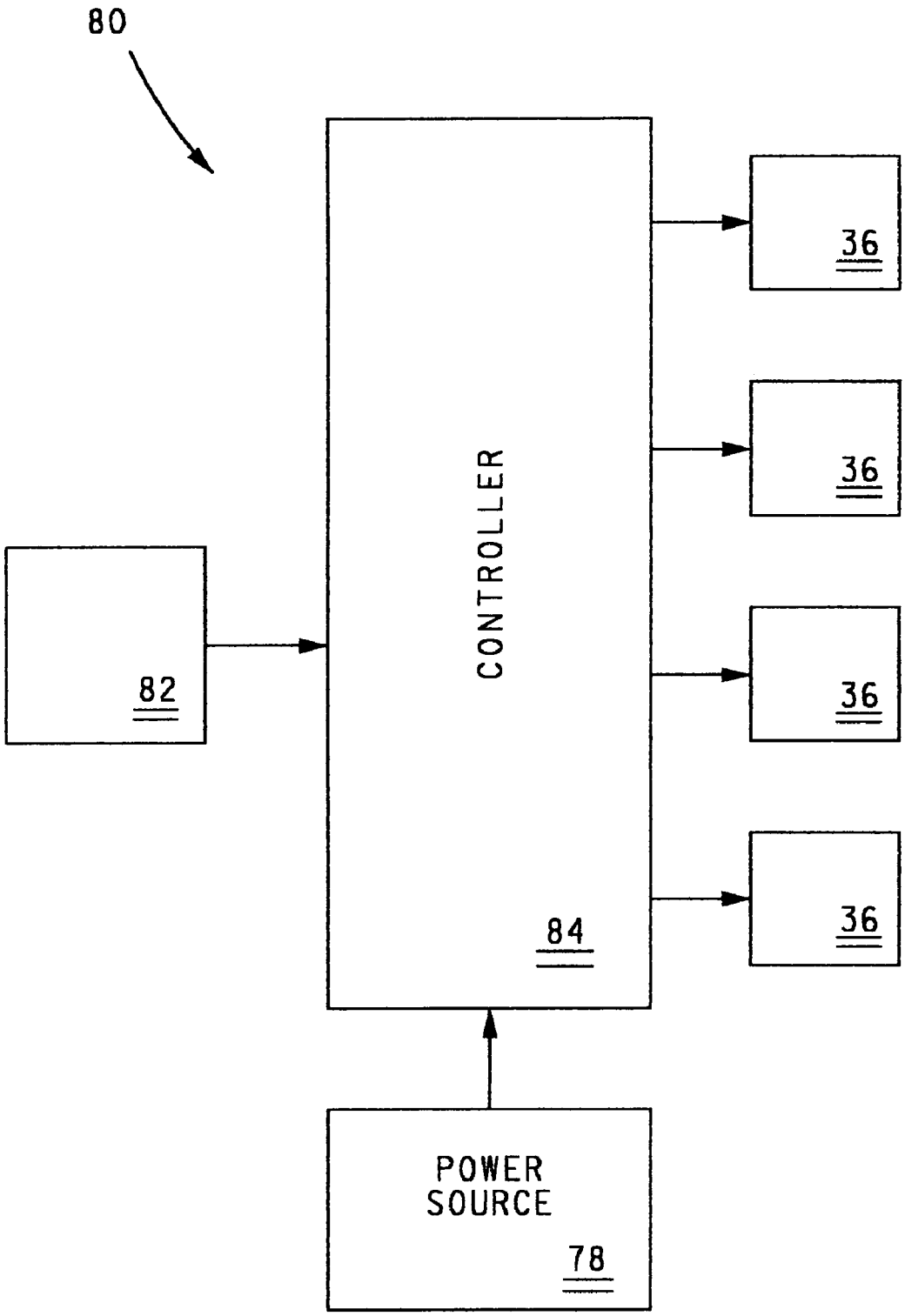
FIG. 6 is a block diagram of a controller of the vortexer shown in FIG. 2.

With reference to FIG. 6, vortexer 20 includes a power source 78, such as a DC power supply, and a device 80 for selectively activating and deactivating each electromagnet 36 with power from power source 78. Device 80 can include a controller 84 configured to selectively activate and deactivate each electromagnet 36 in a predetermined sequence. Controller 84 can be configured to selectively activate the electromagnets 36 in response to user activation of a control means 82, whereupon body 42 and, more particularly, cylindrical member 52 wobbles in response to consecutive portions of lip 50 sequentially contacting ring 74, desirably in a circular manner. Controller 84 can activate electromagnets 36 in a predetermined sequence and at a predetermined speed. The speed at which controller 84 activates electromagnets 36 can be programmable and/or controlled via control means 82 coupled to controller 84. Suitable control means 82 can include, without limitation, a simple mechanical switch, a potentiometer and the like. Also, mixing time can be programmable within controller 84.

As shown in FIGS. 3*a* and 4, enclosure 22 can also include an aperture 88 for housing controller 84. Enclosure 22 is desirably made of a non-magnetic material, such as aluminum or plastic.

In operation, electromagnets 36 are selectively activated in a predetermined sequence, such that body 42 is magnetically drawn toward the surface 38 of each activated electromagnet 36, whereupon a portion of lip 50 contacts ring 74. As each electromagnet 36 in the sequence is activated, either alone or at the same time as the immediately preceeding electromagnet 36 in the sequence, body 42 tilts toward said electromagnet 36, whereupon another portion of lip 50 contacts ring 74. The activation and deactivation of electromagnets 36 can be done in a rotational sequence such that consecutive portions of lip 50 sequentially contact ring 74, thus causing holder 40 and, more particularly, cylindrical member 52 to rotate pivotally or wobble circularly.

Figure 7:
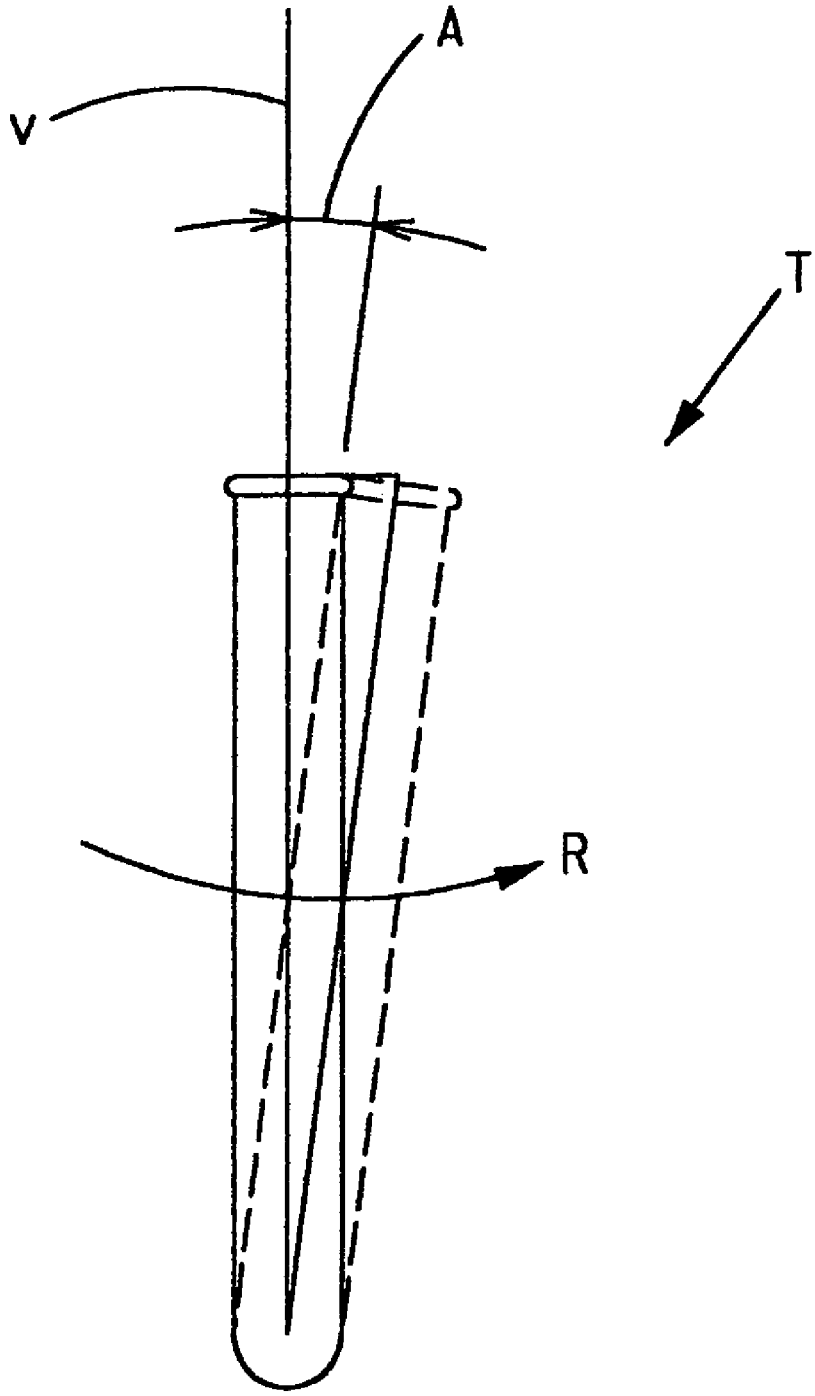
FIG. 7 is an illustration of the stirring action of a test tube using the vortexer shown in FIG. 2.

FIG. 7 shows an upper part of a test tube T at a tilt angle A with respect to a vertical axis V. Test tube T can be received in bore 54 of body 42, whereupon, as the sequential portions of lip 50 sequentially contact ring 74, test tube T wobbles (shown as arrow R) at tilt angle A, thus mixing any fluid received in any test tube T.

It should be understood that the embodiments described herein are for illustrative purposes only and that various modifications or changes in light thereof will be suggested to persons skilled in the art and are to be included within the spirit and purview of this application.

The invention claimed is:

1. A vortexer comprising:

a plurality of electromagnets;

a body pivotally supported above said electromagnets by a shaft, wherein said body includes magnetic material;

a power source;

a device in communication with said electromagnets and said power source for selectively activating each electromagnet with power from said power source, whereupon said body is pivotally attracted toward each electromagnet when activated, wherein:

said electromagnets are arranged around said shaft;

said body includes a peripheral lip that extends away from one side thereof;

said body includes a protrusion spaced from said lip and extending away from said body in the same direction as said lip; and said body is pivotably supported on said shaft via a bore in said protrusion where said shaft is received.

2. The vortexer as claimed in claim 1, wherein said electromagnets are circumferentially arranged around said shaft.

3. The vortexer as claimed in claim 1, wherein said body is disk shaped.

4. The vortexer as claimed in claim 1, wherein:

the body includes a member spaced from said lip and extending away from said body in a direction opposite said lip; and said member includes a bore therein configured to receive a container.

5. The vortexer as claimed in claim 4, wherein said peripheral lip, said member and said protrusion are integral with said body.

6. The vortexer as claimed in claim 1, further comprising a ring mounted around said electromagnets and in spaced relation to said lip, wherein a portion of said lip contacts said ring in response to activation of one of said electromagnets.

7. The vortexer as claimed in claim 6, wherein said device includes a controller for selectively activating said electromagnets in a predetermined sequence such that consecutive portions of said lip sequentially contact said ring whereupon said body wobbles.

8. The vortexer as claimed in claim 1, further comprising an elastic bearing surrounding the protrusion for providing resistance to the pivotable movement of said body.

9. A vortexer comprising:

a shaft;

a plurality of electromagnets positioned around said shaft;

a holder pivotally supported by said shaft above said electromagnets;

a power source; and a controller in communication with said electromagnets and said power source, said controller configured to selectively activate each electromagnet with power from the power source whereupon said holder pivots, wherein:

said holder includes a peripheral lip that extends away from one side thereof;

said holder includes a protrusion spaced from said lip and extending away from said body in the same direction as said lip; and said holder is pivotably supported on said shaft via a bore in said protrusion where said shaft is received.

* * * * *

UNITED STATES PATENT AND TRADEMARK OFFICE

CERTIFICATE OF CORRECTION

PATENT NO. : 7,296,924 B2
APPLICATION NO. : 11/059224
DATED : November 20, 2007
INVENTOR(S) : Czarnek It is certified that error appears in the above-identified patent and that said Letters Patent is hereby corrected as shown below:

On the Title Page, See Item (56) References Cited, U.S. PATENT DOCUMENTS, delete the 8th, 11th and 18th references.

On the Title Page, See Item (56) References Cited, FOREIGN PATENT DOCUMENTS, delete both German references.

In other words, delete the following:

| | | |
|---|---|---|
| 6,141,604 A | 10/2000 | Mattes et al. |
| 6,424,897 B1 | 7/2002 | Mattes et al. |
| 2002/0075140 A1 | 6/2002 | Yeh et al. |
| DE 196 09 176 | 9/1997 | |
| DE 197 44 083 | 4/1999 | |

Signed and Sealed this

Seventeenth Day of June, 2008

JON W. DUDAS
*Director of the United States Patent and Trademark Office*